US006422903B1

(12) United States Patent
Fekonja et al.

(10) Patent No.: US 6,422,903 B1
(45) Date of Patent: Jul. 23, 2002

(54) INTERLOCKING PLUG-IN CONNECTOR PART FOR AN ELECTRICAL PLUG-IN CONNECTOR

(75) Inventors: Rulolf Fekonja, Munich; Peter Epe, Lennestadt, both of (DE)

(73) Assignee: Leopold Kostal GmbH & Co. (DE)

( * ) Notice: Subject to any disclaimer, the term of this patent is extended or adjusted under 35 U.S.C. 154(b) by 0 days.

(21) Appl. No.: 09/673,689

(22) PCT Filed: Jun. 25, 1999

(86) PCT No.: PCT/EP99/04425

§ 371 (c)(1),
(2), (4) Date: Oct. 19, 2000

(87) PCT Pub. No.: WO00/03457

PCT Pub. Date: Jan. 20, 2000

(30) Foreign Application Priority Data

Jul. 9, 1998 (DE) ..... 198 30 671

(51) Int. Cl.[7] ..... H01R 13/514
(52) U.S. Cl. ..... 439/752; 439/314
(58) Field of Search ..... 439/752, 595, 439/447, 347, 587, 314–319; 29/883; 285/319

(56) References Cited

U.S. PATENT DOCUMENTS 5,485,673 A * 1/1996 Lau ..... 29/883

* cited by examiner

*Primary Examiner*—Tho D. Ta
*Assistant Examiner*—Phuongchi Nguyen
(74) *Attorney, Agent, or Firm*—Brooks & Kushman, P.C.

(57) ABSTRACT

An interlocking plug-in connector put for an electrical plug-in connector includes a housing for receiving electrical contacts and a bayonet ring. The bayonet ring is longitudinally displaceable relative to the housing and is movable from an assembled position in which a mounting end of the bayonet ring is arranged on the plane of a mounting surface of the housing or on a plane which is staggered in the direction of connection in relation to the mounting surface of the housing. The bayonet ring tray be longitudinally displaced from the assembled position to a connecting position such that an insertion end of the bayonet ring is positioned in arranged within a region of the mounting surface of the housing. In the insertion position, the bayonet ring is supported on a stop associated with the housing to push the housing into a guide bushing.

3 Claims, 3 Drawing Sheets

INTERLOCKING PLUG-IN CONNECTOR PART FOR AN ELECTRICAL PLUG-IN CONNECTOR

TECHNICAL FIELD

The invention pertains to a lockable plug-in connection part for an electric plug-in connector, with a housing that contains electric contact elements, and with a bayonet ring for locking the plug-in connection part on a guide sleeve assigned to the plug-in connector, wherein the plug-in connection part is inserted into one end of the guide sleeve in order to produce the electric plug-in connector, and a counterpiece that carries complementary contact elements is arranged on the opposite end of the guide sleeve.

BACKGROUND ART

A lockable plug connection part of this type is, for example, required for producing an electric plug-in connector that serves for connecting transmission control systems in motor vehicles. In this case, the socket plug-in used is realized in the form of a lockable plug-in connection part. In such transmission control systems, an electrical-equipment board is arranged within the transmission housing which carries the electrical, mechanical and/or hydraulic control means usually provided for such transmission control systems, as well as control electronics allocated functionally for these control means. In order to contact the electrical-equipment board, a plug-in part that contains electrical contact pins is assigned to the electrical-equipment board. Electrical contact between the plug-in part or its plug-in contacts and a plug-in socket that contains electrical contact sockets is realized by means of a guide sleeve that extends through an assembly opening of the transmission wall and is connected to the plug-in part with its inner end region, wherein the plug-in socket is inserted into the guide sleeve that is open on the outer side. For this purpose, a socket housing which carries the contact sockets as well as a bayonet ring are assigned to the plug-in socket, and the bayonet ring is realized such that it locks the plug-in socket onto the guide sleeve. Since the electric plug-in contacts are arranged on the electrical-equipment board within the transmission housing, the socket housing needs to be long enough so that it can be inserted sufficiently far into the guide sleeve in order to produce the desired electrical contacts. The bayonet ring is arranged on the end of the socket housing on the cable outlet side. Such a lockable plug-in socket is known from German Utility Model 297 21 908.1.

In order to produce an electrical contact between the plug-in contacts and the contact sockets contained in the socket housing, the socket housing or the entire plug-in socket, respectively, is realized with a corresponding length. Due to the bayonet locking of the plug-in socket on the guide sleeve, it is proposed to merely realize the end of the socket housing on the cable outlet side in an annular fashion so as to reduce the material requirement, with the bayonet ring being rotatably held on this annular end section. The required length of the socket housing as well as the annular design of this socket housing on the cable outlet side, makes it impossible to realize an automatic mounting of the contact sockets on the socket housing. This type of mounting is carried out from the cable outlet side of the socket housing. An automated mounting is only possible if the socket housing does not exceed a certain length such that the contact sockets to be mounted which are carried by the grippers of the automated mounting machine can be mounted at their intended position in socket receptacles of the socket housing. In addition, an automated mounting can only be carried out if the mounting surface of the socket housing on the cable outlet side is flat and there are no edges or webs, as the annular end section provided for holding the bayonet ring sometimes protrudes from said mounting surface. Consequently, contact sockets can only be mounted naturally onto this previously known plug-in socket or its socket housing.

SUMMARY OF THE INVENTION

Based the previously discussed state of the art, the invention aims to propose a lockable plug-in connection part for an electric plug-in connector which is not only suitable for contacting a counterpiece at a certain insertion depth, but on which electrical contact elements to be inserted into the plug-in connection part can also be mounted in an automated fashion.

According to the invention, this objective is attained due to the fact that the bayonet ring can be longitudinally displaced relative to the housing and the end of the bayonet ring on the cable outlet side is, in a mounting position of the plug-in connection part for mounting contact elements on the housing, situated in the plane of the end of the housing on the cable outlet side or in a plane which, relative to the plane of the end of the housing on the cable outlet side, is offset in the insertion direction, and due to the fact that the end of the bayonet ring on the insertion side is situated in an inserting position that is spaced apart from the mounting position, namely within the region of the end section of the housing on the cable outlet side, with the bayonet ring being supported in the insertion direction by an insertion limit stop that is assigned to the housing in this particular position in order to insert the housing into the guide sleeve.

The plug-in connection part according to the invention, e.g., a plug-in socket, is characterized by a bayonet ring that is arranged such that it can be longitudinally displaced relative to the socket housing. In this respect, it is proposed that the bayonet ring is arranged relative to the socket housing such that the plane of the end of the socket housing at the cable outlet side represents the outer limit of the plug-in socket in one position of the bayonet ring-namely the mounting position. This end can be used as the mounting surface for the automated mounting of electrical contact sockets onto the socket housing. Since the bayonet ring can be longitudinally displaced relative to the socket housing, the bayonet ring can be displaced into a locking or inserting position which is spaced at a distance from the aforementioned mounting position. This position is characterized by the fact that the front end of the bayonet ring or the end of the bayonet ring on the insertion side is situated within the region of the rear end section of the socket housing, wherein the bayonet ring is supported by an insertion limit stop assigned to the socket housing in this position. Consequently, the socket housing can be pulled out of the bayonet ring in a telescoping fashion in the insertion direction. Due to this telescoping function, the socket housing merely needs to have a length that suffices for receiving the electrical contact sockets, wherein the socket housing, and in particular, the bayonet ring arranged on the end of the socket housing on the cable outlet side in the insertion position, contributes to achieving the required insertion depth. Such a plug-in socket is suitable for all electric plug-in connectors, the plug-in sockets of which need to extend to a certain insertion depth in order to produce an electrical connection with the plug-in contacts assigned to the plug-in part. A plug-in socket of this type is particularly suitable for an electric plug-in connector that serves for producing an electrical contact with an electrical-equipment board arranged underneath a wall, in particular, a transmission housing wall.

It is practical to fix the bayonet ring in its mounting position relative to the housing because this presents an unintentional displacement of the bayonet ring during an automated mounting process. This is preferably realized by arranging several snap-in beads around the circumference of the bayonet ring, with said snap-in beads engaging into snap-in depressions assigned to the housing and situated on the outer side of the insertion limit stop.

In one embodiment, insertion tabs which protrude from the housing are provided as the insertion limit stop, with flange sections assigned to the bayonet ring being supported by the surfaces of the insertion tabs which point toward the cable outlet of the housing in the inserted position of the bayonet ring. It is practical to guide the insertion tabs in a guide groove that preferably consists of two webs and that is assigned to the inner side of the bayonet ring, with this guide groove being realized such that the insertion tabs have emerged from the guide groove in the inserted position of the bayonet ring and the bayonet ring can only be turned relative to the housing in its inserted position. In order to limit the inserted position of the bayonet ring, a limiting flange is assigned to the end of the housing. In order to prevent the bayonet ring from unintentionally sliding back from its inserted position, one embodiment proposes that springable locking tabs which point toward the cable outlet side of the housing are assigned to the housing, with the ends of these locking tabs being supported by the insertion flange of the bayonet ring once the bayonet ring is transferred from its mounting position into its inserted position. A renewed displacement of the bayonet ring from its inserted position into its mounting position is not necessary because the mounting position is only required for mounting electrical contact elements on the housing.

The advantages of the invention are described on the example of a plug-in socket; however, the plug-in connection part according to the invention may be analogously realized in the form of a plug-in part.

BRIEF DESCRIPTION OF THE DRAWINGS

Additional advantages and developments of the invention are disclosed in the remaining subordinate claims and described below with reference to one preferred embodiment. Shown are:

BEST MODES FOR CARRYING OUT THE INVENTION

Figure 1:
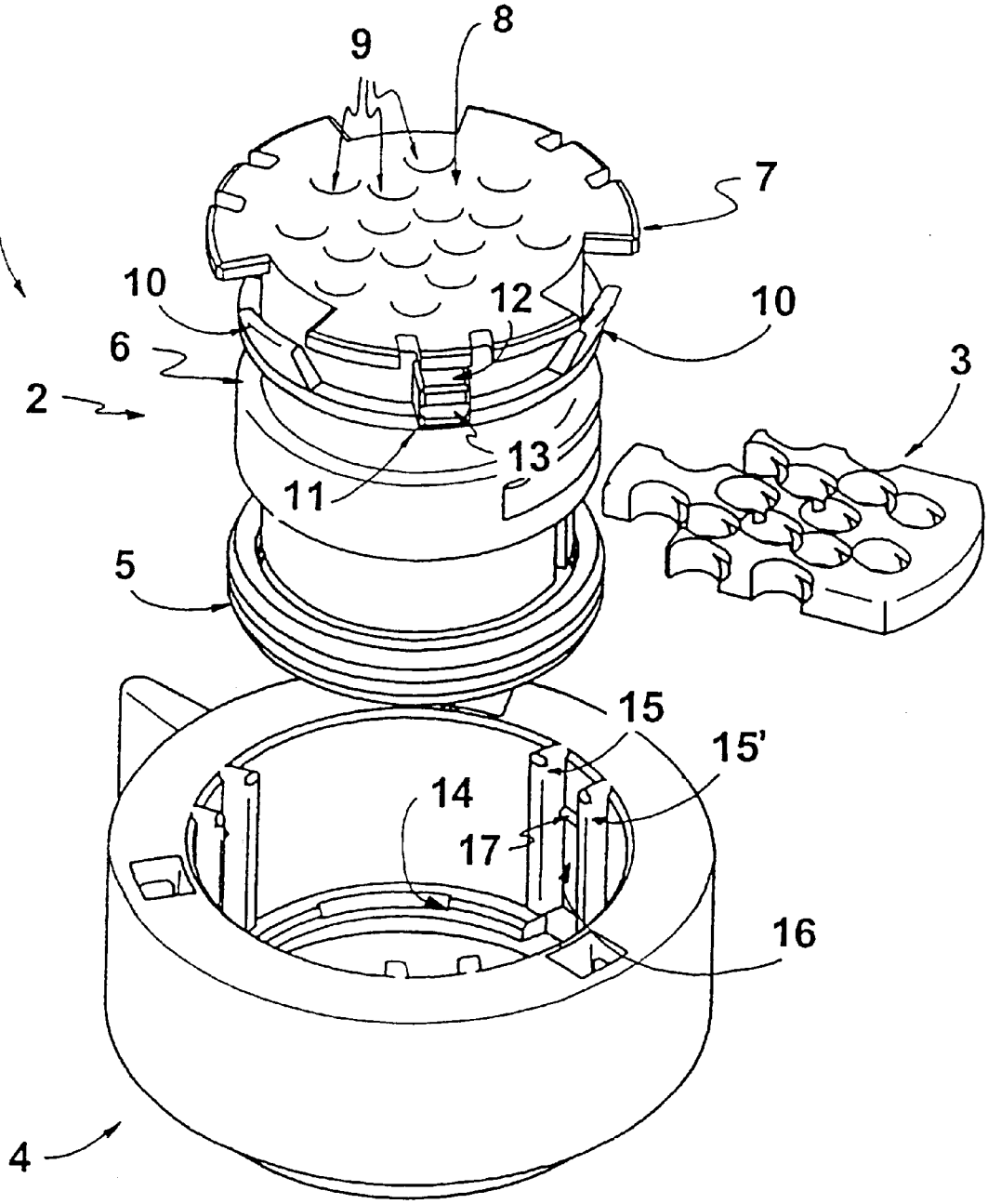
FIG. 1, a schematic representation of a plug-in socket for an electric plug-in connector in the form of an exploded view.

The plug-in socket 1 shown FIG. 1 essentially consists of a socket housing 2, into which a locking disk 3 can be radially inserted in order to lock electrical contact sockets in position, and a bayonet ring 4. The socket housing 2 is illustrated in its empty state, i.e., a state in which it does not contain electrical contact sockets. A ring seal 5 that is inserted into the groove identified by the reference symbol 6 in order to seal the socket housing 2 relative to a guide sleeve that is not illustrated in detail is arranged in the lower section of the socket housing 2 on the insertion side.

The socket housing 2 is essentially composed of cylindrical sections and limited by a limiting flange 7 on the cable outlet side. Socket receptacles 9 are arranged in the surface 8 of the socket housing 2 on the cable outlet side. The surface 8 represents the mounting surface, on which electrical contact sockets are automatically mounted on the socket receptacles 9, and on the rear side of which corresponding electrical cables are automatically mounted. Elastic locking tabs 10 which point to the limiting flange 7 are integrally formed on the socket housin 2 a certain distance underneath the limiting flange 7. The locking tabs 10 are able to yield within the region of their protruding sections. Three locking tabs 10 of this type are circumferentially arranged on the socket housing 2. Insertion tabs 11 which protrude radially from the outer surface of the socket housing 2 are respectively arranged between two locking tabs 10, wherein the surfaces of said insertion tabs which point toward the limiting flange 7 and consequently to the end of the socket housing 2 on the cable outlet side are realized in the form of flat pressure surfaces 12. A snap-in depression 13 is arranged in the radially outward directed surface of each insertion tab 11.

The bayonet ring 4 is realized in an annular fashion, with an insertion flange 14 being arranged within the region of its front end on the insertion side. The clear width of the opening of the bayonet ring 4 within the region of the insertion flange 14 is so large that the cylindrical socket housing 2 can be inserted until the underside of the limiting flange 7 rests on the upper side of the insertion flange 14. On its inner side, the bayonet ring 4 contains guides 16 formed by two webs 15, 15' in positions that are complementary to those of the insertion tabs 11. In this case, the distance between the webs 15, 15' is so large that an insertion tab 11 can be received.

An inwardly protruding snap-in bead 17, by means of which the bayonet ring 4 is fixed in its mounting position relative to the socket housing 2 due to the engagement into the snap-in depression 13, is situated in the upper section of a guide 16. The axial length of the guide 16 and the two webs 15, 15', respectively, is so large that a sufficient distance for turning the limiting flange 17 on the insertion flange surface remains between the lower edges of the webs 15, 15' and the upper side of the insertion flange 14. The insertion flange 14 is interrupted within the region situated underneath a guide 16 such that the insertion tabs 11 in the guides 16 can be guided up to a position with their pressure surface 12 underneath the underside of the insertion flange 14.

Figure 2:
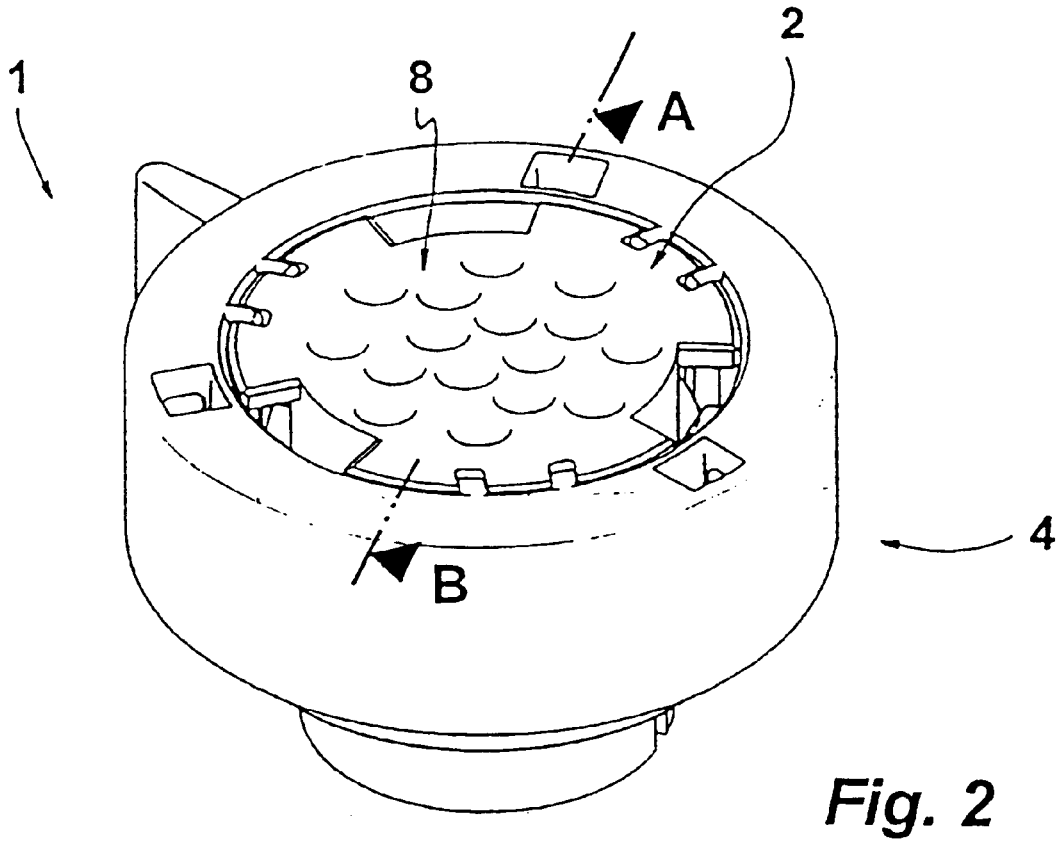
FIG. 2, a perspective view of the plug-in socket according to FIG. 1, the bayonet ring of which is situated in its mounting position.

The description of this arrangement makes it clear that the bayonet ring 4 is prevented from moving in the longitudinal direction in its mounting position and prevented from carrying out a rotational movement due to the position of the insertion tabs 11 in the guides 16. This arrangement of the plug-in socket 1 is illustrated in FIG. 2—the bayonet ring 4 is situated in its mounting position relative to the socket housing 2 with the end of the bayonet ring 4 on the cable outlet side situated in the plane of the surface 8. This illustration makes it clear that a plane mounting surface is created such that electrical contact sockets can be automatically mounted on the socket housing 2.

Figure 3:
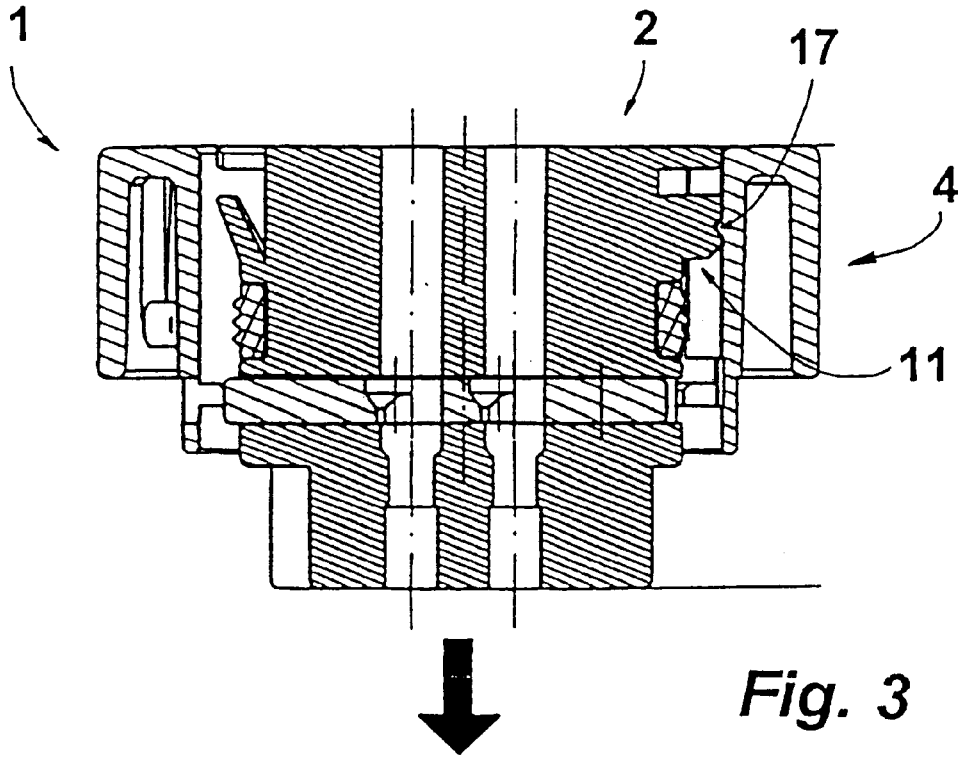
FIG. 3, a cross section through the plug-in socket according to FIG. 2 along the line A–B, and FIG. 4, a section which corresponds to the cross section shown in FIG. 3 through the plug-in socket according to FIG. 2, with the bayonet ring being situated in its inserted position.
Figure 4:
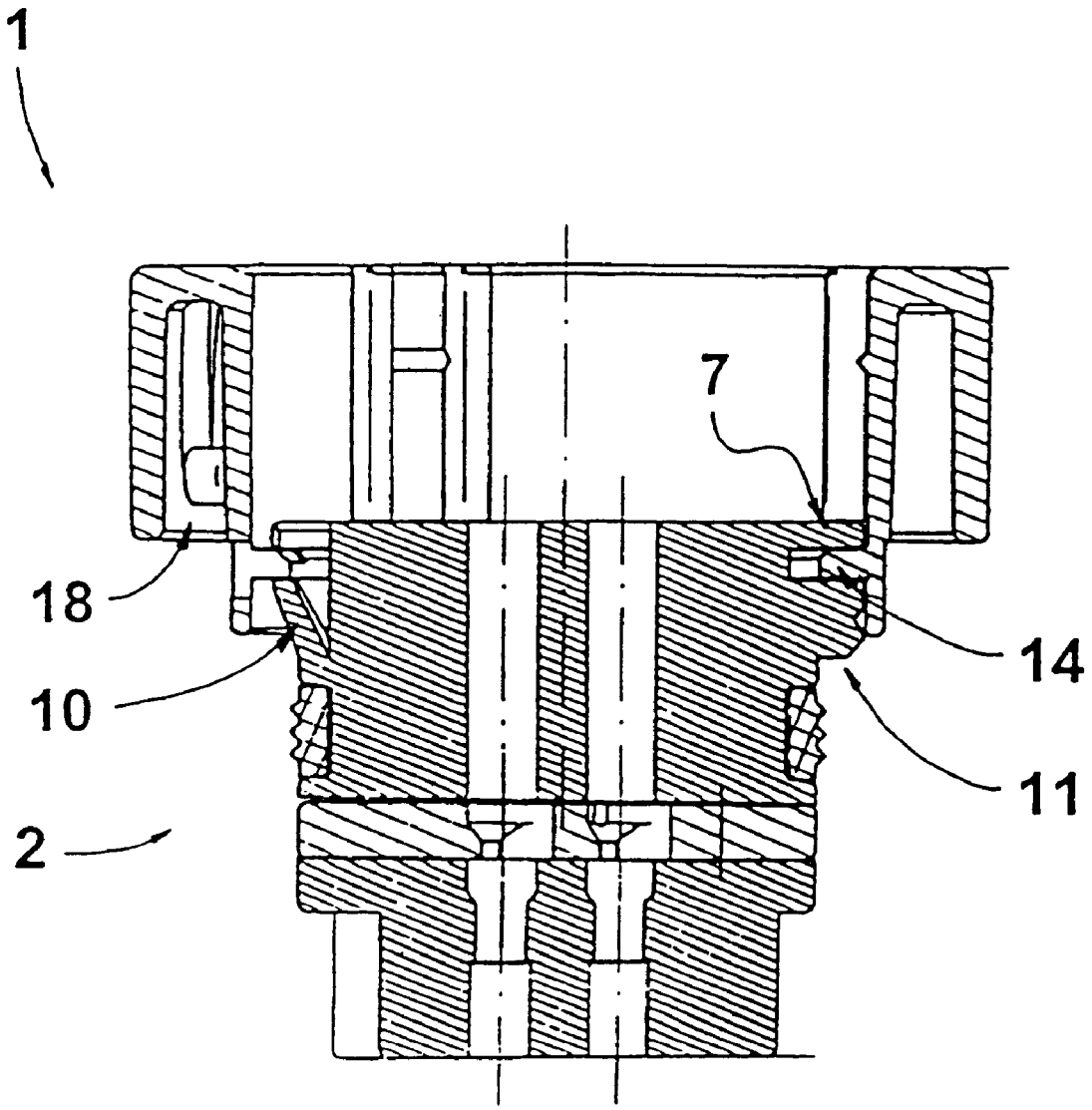

The engagement of a snap-in bead 7 in the snap-in depression 13 of an insertion tab 11 is shown in the cross section of the bayonet ring 4 which is situated in its inserted position in FIG. 3. After the automated mounting of the electrical contact sockets onto the socket housing 2, the socket housing 2 is pushed out of the bayonet ring 4 in a telescoping fashion as indicated by the arrow shown in FIG. 3 until the insertion flange 14 of the bayonet ring 4 rests against the limiting flange 7 of the socket housing 2. This position—the inserted position—is shown in FIG. 4 in the form of a cross section that corresponds to that shown in FIG. 3. While the socket housing 2 is pushed out of the bayonet ring 4, the insertion flange 14 is also guided over the locking tabs 10 which protrude in a springing fashion as soon as the insertion flange 14 has moved over said locking tabs, and thus prevents the bayonet ring 4 from sliding back from its position shown in FIG. 4. Once the bayonet ring 4 is pushed into the position shown in FIG. 4, it is turned relative to the socket housing 2 such that the insertion flanges 14 interrupted within the region of the guides 16 are moved over the insertion tabs 11 that are now situated on the bottom. The plug-in socket 1 can subsequently be inserted into a guide sleeve that is not illustrated in detail so as to contact electric plug-in contacts situated on the other end of the guide sleeve. During this insertion process, the required insertion pressure is exerted upon the socket housing 2 by the insertion flanges 14 which are supported on the upper side of the insertion tabs 11. In order to lock the plug-in socket 1 in position, the free end section of the guide sleeve engages into a locking groove 18 of the bayonet ring 4 such that the bayonet ring 4 is locked on the guide sleeve. The locking groove required for this purpose is preferably realized such that the socket housing 2 is additionally inserted into the guide sleeve during this interlocking process.

LIST OF REFERENCE SYMBOLS

1 Plug-in socket
2 Socket housing
3 Locking disk
4 Bayonet ring
5 Ring seal
6 Groove
7 Limiting flange
8 Surface on the cable outlet side
9 Socket receptacle
10 Locking tab
11 Insertion tab
12 Pressure surface
13 Snap-in depression
14 Insertion flange
15, 15' Web
16 Guide
17 Snap-in bead
18 Locking groove

What is claimed is:

1. A plug-in socket for an electronic plug-in connector, the plug-in socket comprising:

a housing having a mounting surface with socket receptacles for receiving electrical contact elements, the housing having an insertion limit stop;

a bayonet ring circumferentially extending around the housing for locking the housing to a first end of a guide sleeve, the bayonet ring having a mounting end and an inserting end, the inserting end having an insertion means; and a plug-in part arranged on the opposite end of the guide sleeve, the plug-in part carrying complimentary plug-in part contact elements;

wherein the bayonet ring is longitudinally displaceable relative to the housing between a mounting position for enabling electrical contact elements to be mounted through the socket receptacles of the mounting surface of the housing and an inserting position for enabling mounted electrical contact elements to engage with the complementary plug-in part contact elements, wherein in the mounting position the mounting end of the bayonet ring is arranged in the plane of the mounting surface of the housing, wherein in the inserting position the insertion end of the bayonet ring is arranged within a region of the mounting surface of the housing and the insertion means of the inserting end of the bayonet ring engages with the insertion limit stop of the housing in order to insert the housing into the guide sleeve in response to an insertion force applied to the bayonet ring;

wherein the bayonet ring includes a snap-in connection cooperating with the housing for holding the bayonet ring in the mounting position while electrical contact elements are mounted through the socket receptacles of the mounting surface of the housing, wherein the snap-in connection includes snap-in beads of the bayonet ring which engage into snap-in depressions of the insertion limit stop of the housing.

2. A plug-in socket for an electronic plug-in connector, the plug-in socket comprising:

a housing having a mounting surface with socket receptacles for receiving electrical contact elements, the housing having an insertion limit stop;

a bayonet ring circumferentially extending around the housing for locking the housing to a first end of a guide sleeve, the bayonet ring having a mounting end and an inserting end, the inserting end having an insertion means; and a plug-in part arranged on the opposite end of the guide sleeve, the plug-in part carrying complimentary plug-in part contact elements;

wherein the bayonet ring is longitudinally displaceable relative to the housing between a mounting position for enabling electrical contact elements to be mounted through the socket receptacles of the mounting surface of the housing and an inserting position for enabling mounted electrical contact elements to engage with the complementary plug-in part contact elements, wherein in the mounting position the mounting end of the bayonet ring is arranged in the plane of the mounting surface of the housing, wherein in the inserting position the insertion end of the bayonet ring is arranged within a region of the mounting surface of the housing and the insertion means of the inserting end of the bayonet ring engages with the insertion limit stop of the housing in order to insert the housing into the guide sleeve in response to an insertion force applied to the bayonet ring;

wherein the insertion limit stop of the housing includes insertion tabs protruding radially from the housing, wherein the insertion means of the bayonet ring is supported on surfaces of the insertion tabs pointing toward the mounting surface of the housing when the bayonet ring is in the inserting position.

3. The plug-in socket of claim 2 wherein:

the insertion tabs are respectively accommodated in guides arranged on the bayonet ring, the guides each including two guide webs such that the bayonet ring is rotatably held relative to the housing when the bayonet ring is in the mounting position, wherein the guides end in front of the insertion means of the bayonet ring such that the bayonet ring is rotatable relative to the housing when the bayonet ring is in the inserting position.

* * * * *